US005480355A

United States Patent [19]

Miller

[11] Patent Number: 5,480,355

[45] Date of Patent: Jan. 2, 1996

[54] CHILD'S CAROUSEL

[76] Inventor: Terry L. Miller, 300 E. Shoop Rd., Tipp City, Ohio 45371

[21] Appl. No.: 262,018

[22] Filed: Jun. 17, 1994

[51] Int. Cl.[6] ..... A63G 1/00

[52] U.S. Cl. ..... 472/29; 472/35

[58] Field of Search ..... 472/14, 15, 1, 472/29, 32, 33; 482/23, 33; D21/249

[56] References Cited

U.S. PATENT DOCUMENTS

| | | | |
|---|---|---|---|
| D. 338,702 | 8/1993 | Ligas | D 21/249 |
| 1,693,724 | 12/1928 | Morris | 472/32 |
| 2,688,483 | 9/1954 | Mugler | 472/14 |
| 4,936,569 | 6/1990 | West | 472/14 |

*Primary Examiner*—Brian K. Green
*Assistant Examiner*—Kien T. Nguyen
*Attorney, Agent, or Firm*—William Weigl

[57] ABSTRACT

A backyard carousel for small children is constructed from tubing and fittings which are attached into a lightweight unitary superstructure. The tubing and fittings are preferably plastic, with the joints preferably being permanently bonded with a plastic cement. The superstructure is freely rotatable on standard steel pipe, one section of which is firmly anchored in a base surface such as concrete and has its upper end flush with the ground surface, while the other section of which fits inside the one section and extends upwardly to form an internal post for journaling a hub of the tubing superstructure. A thrust bearing between the hub and post facilitates free rotation of the superstructure. Seating is arranged around the periphery of the superstructure with sufficient space between the inner edges of the seats and the hub for children to dangle their legs and rotate the superstructure by foot contact witch the ground. The leg space is large enough for an adult to step thereinto to vertically lift and remove the superstructure and post to enable grass beneath the carousel to be mowed.

16 Claims, 2 Drawing Sheets

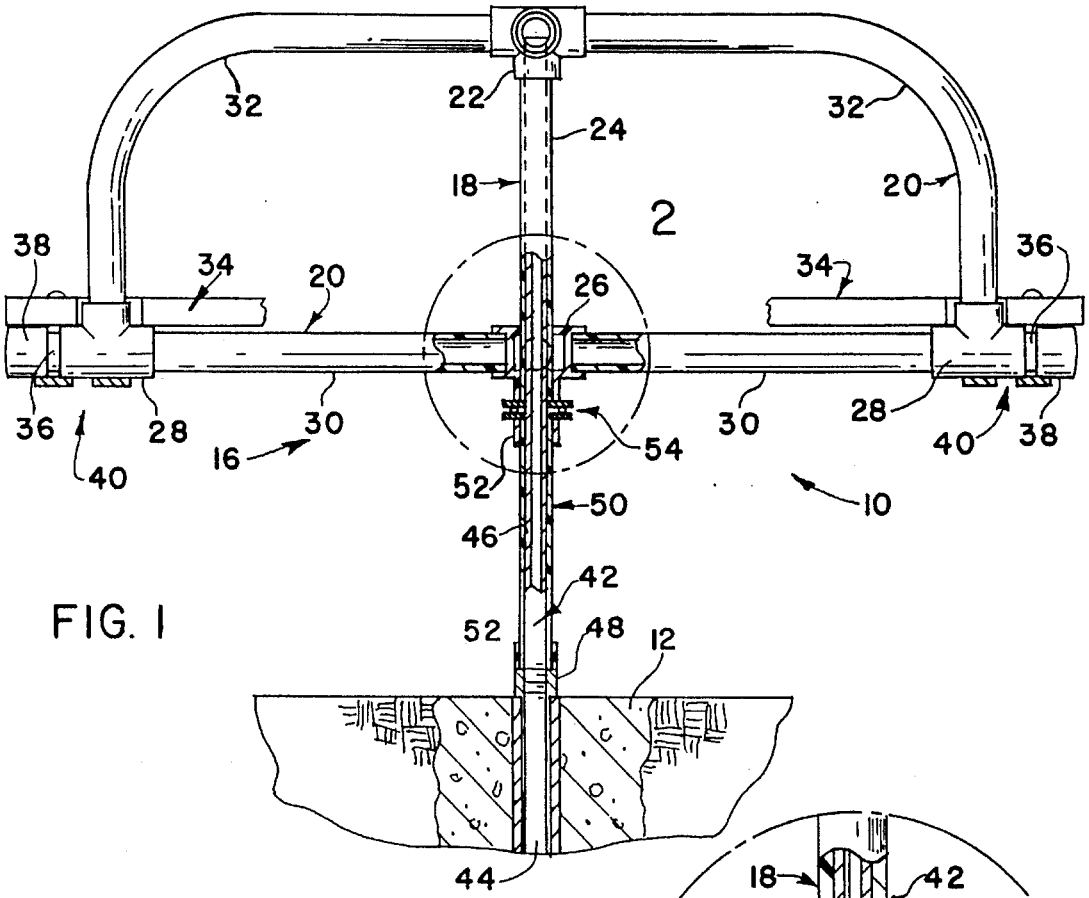
FIG. 1
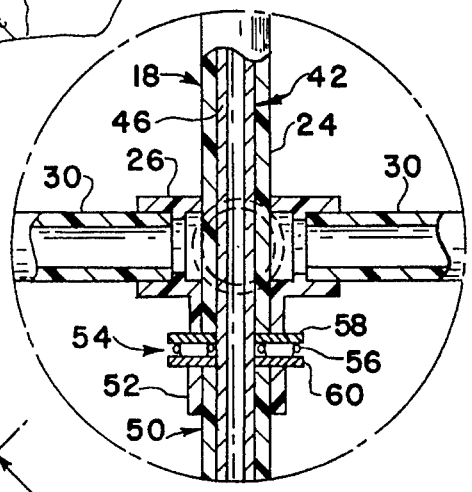
FIG. 2
FIG. 3
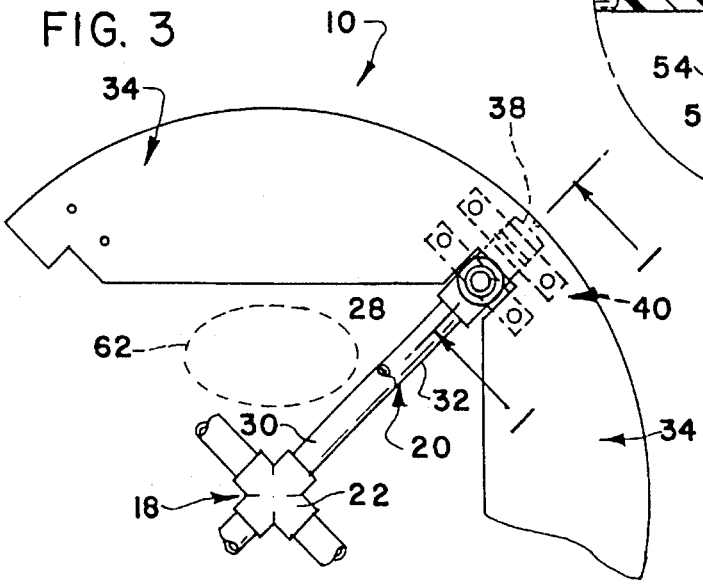

CHILD' S CAROUSEL

This invention relates generally to a carousel or merry-go-round for small children, particularly for use in a residence backyard or child care playground.

BACKGROUND OF THE INVENTION

Although swings, slides, climbers, "monkey bars" and other pieces of playground-type equipment are common in gym sets found in the backyards of many homes with small children, it is relatively uncommon to find a yard with any kind of carousel. Typical playground and schoolyard carousels are heavy and bulky. Their designs are generally not conducive for downsizing to a smaller, portable unit. Portability of a backyard carousel is important to enable mowing of grass therebeneath or placement indoors for storage during winter. Large gym sets remain outdoors all year and must be mowed around (and trimmed) if grass is permitted to grow where they enter the ground.

Some small units have been on and off the market in a relatively short time, apparently being unable to withstand the rigorous activity of children. One such unit is free-standing, and because of its potential to tip over, was designed with a very low center of gravity. Instead of allowing the children to be seated with their legs dangling as is customary on park or school playground merry-go-rounds, they have to stand on a platform which is only about six inches above ground level. Another backyard unit is designed as an injection-molded one piece very low children-seating section for tiny tots. Its entire upper surface is enclosed, either requiring an adult to rotate the unit or requiring the children to be seated facing outwardly in order to use their feet to propel the unit. This design necessarily requires a fairly large and costly mold to produce. Still another known carousel attaches at the upper end of a long vertical center post to a horizontal cross-beam or cantilevered arm of a gym set, with the lower end of the post being supported either in the ground, asphalt or concrete. It too has a relatively low "standing" platform, sufficient only for two children to play on at one time. It is small in diameter and high in overall length, thus it is doubted that it can develop sufficient centrifugal force to rotate or to allow coasting for more than a few revolutions. For the children to propel the latter unit by themselves, it would require that they stand with one leg on the platform and use the other to reach backward or sideways to the ground level to activate or continue movement of the platform. Possibly, they could run alongside the carousel and jump onto the platform once it is moving, but this has the possibility of child endangerment. With only nominal coasting capability, frequent reaching down would become necessary to foot-pedal the unit with one leg.

SUMMARY OF THE INVENTION

A backyard carousel for small children is constructed from tubing and fittings which are attached into a lightweight unitary superstructure. The tubing and fittings are preferably off-the-shelf PVC (polyvinyl chloride) components used in outdoor furniture, and can be bonded by cementing into a firm and relatively rigid structure. The superstructure is freely rotatable about standard steel pipe, one section of which is firmly anchored in a base surface such as concrete and has its upper end flush with the ground surface while the other section of which fits inside the one section and extends upwardly to form an internal post for journaling a hub of the superstructure. A thrust bearing between the bottom end of the hub and a fixed-height shoulder surrounding the post facilitates free rotation and coasting of the superstructure. Seating is arranged around the periphery of the superstructure with sufficient space between the inner edges of the seats and the hub for children to dangle their legs and rotate the superstructure by foot contact with the ground. The leg space is large enough for an adult to step thereinto to vertically lift and remove the superstructure and post to enable grass beneath the carousel to be mowed.

It is a principal object of my invention to provide a low cost, lightweight child's carousel which can be assembled from purchased components used in the outdoor furniture industry.

More specifically, an object is to construct the main structural components of the carousel from common PVC tubing and fittings, with galvanized or other steel pipe being used as an axle. Ancillary thereto is to enable chemical bonding of the various joints, resulting in a strong superstructure capable of supporting as many as four small children.

A further object is to provide a carousel with a plastic pipe superstructure journaled on a vertical post with a thrust bearing receiving the load of the children and superstructure and thereby enabling free and easy coasting and rotation of the carousel by the children themselves.

Another object is to provide a lightweight portable carousel of the type where children can be seated facing toward each other with their legs dangling to enable foot propelling of the carousel. The space for their legs can also serve to allow an adult to step into the space to lift and remove the carousel.

A further object is to provide a lightweight, portable child's carousel constructed primarily of PVC tubing and fittings which can be easily assembled from kit form without concern of misalignment of joints during cementing them together, this being made possible by preassembly at the factory level of selected subassemblies of those components which are most likely to be misaligned by an inexperienced assembler.

Other objects and advantages will become apparent from the following description, in which reference is made to the accompanying drawings.

In the Drawings FIG. 1 is an elevational, partly fragmentary view of the carousel supported for rotation about a post fixed in the ground.

FIG. 2 is an enlarged view of details found within the dot-dash circle 2 of FIG. 1.

FIG. 3 is a fragmentary plan view of the carousel of FIG. 1, taken at an angle of 45 degrees with respect to the FIG. 1 position.

DESCRIPTION OF THE PREFERRED EMBODIMENT

Figure 4:
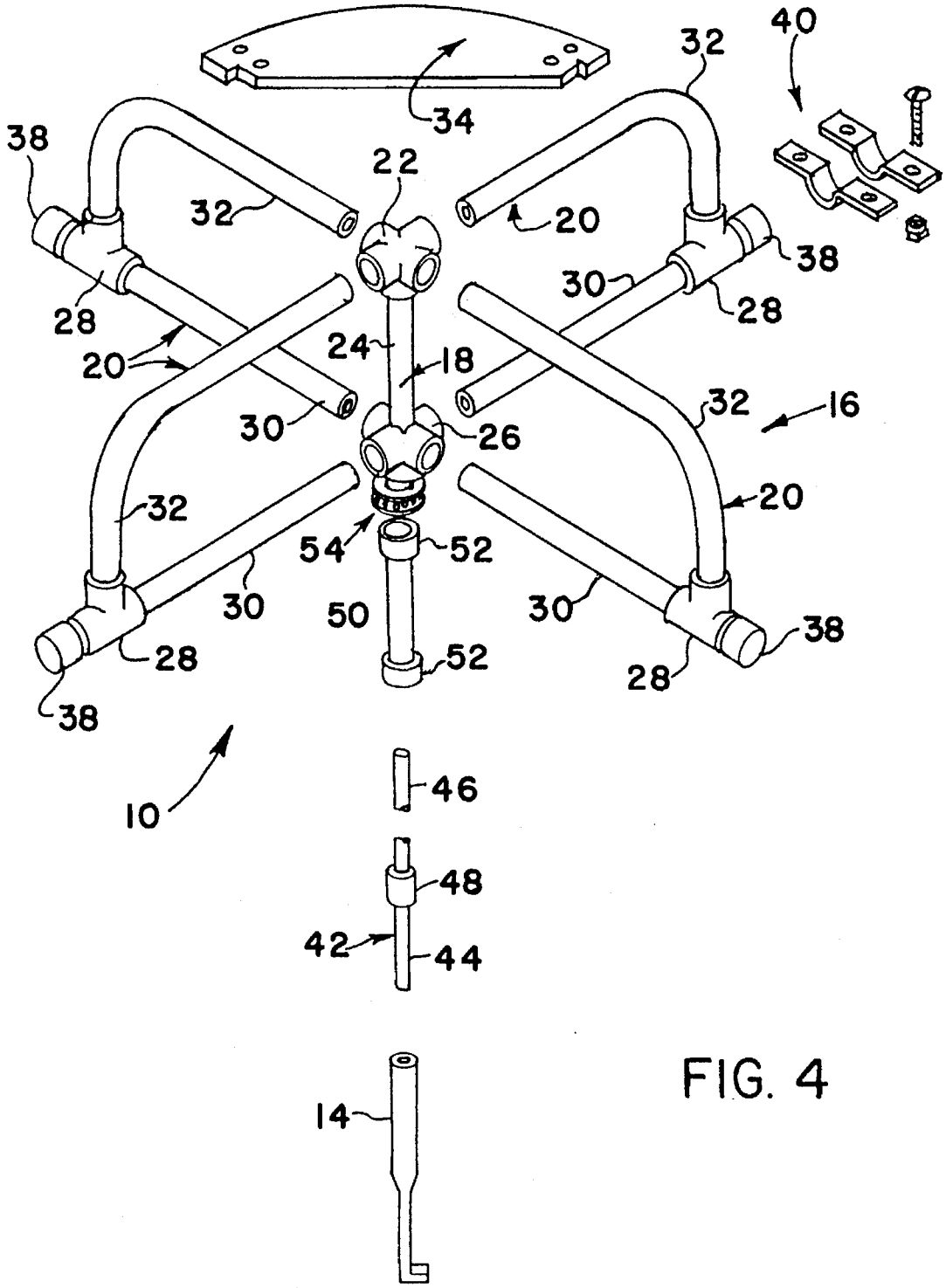
FIG. 4 is an exploded isometric view of the carousel in elevation.

A side elevational, partly fragmentary view of a carousel 10 set in concrete 12 in ground of a backyard or playground is shown in FIG. 1. The ground may or may not be capable of growing grass, but if it is, it will be seen from the following description that the carousel 10 may be removed from a pipe 14 located in the concrete, enabling the grass beneath the carousel to be mowed.

The structure of the carousel is such that its use is intended primarily for small children, between the ages of about three to nine, but more likely from about three to seven. Its overall height from ground level to top is approximately 28 inches, and its diameter is approximately 48 inches. It is relatively small in comparison to conventional schoolyard and playground carousels. Such carousels offered no assistance in designing a small unit for backyard use, particularly in the area of being sufficiently lightweight and portable to permit removal if desired or necessary. To use materials and construction of the large playground type of unit would have resulted in a unit too cumbersome and heavy for easy lifting by a single individual. Being familiar with the strength of bonded PVC tubing and fittings used in the plumbing industry, a prototype unit was designed and built. It was found quite adequate in strength and durability and weighed only 33 pounds. It was light enough in weight to enable lifting by most adults. However, because of the nature of PVC and the method of cementing PVC tubing and joints, its assembly by an average "do-it-yourselfer" did not seem practical. When cementing a PVC tube: into a fitting, it sets firmly in only a few seconds. Therefore, if angularity of the tube in relation to the fitting is of significance, its positioning in the tube must be precise and accurate. Any mistake in misaligning the tube with its opening in the fitting during assembly would result in parts that would no longer be of use in the carousel. As will be seen later, the misalignment problem is solved (if the components are to be finally assembled by an end purchaser) by preassembling certain subassemblies in which alignment is critical.

In addition to this, it is known that PVC used in the plumbing industry is subject to discoloration and degradation due to outdoor sunlight exposure. However, the outdoor plastic furniture industry has formulated UV-resistant PVC tubing and fittings. They can be bonded just like plumbing materials, but are also subject to a very rapid setting time when cemented. All of the PVC components of a superstructure 16 of the carousel 10 can be purchased as off-the-shelf items from manufacturers of outdoor plastic furniture materials, and only one component requires slight modification. Nothing needs to be specially molded, therefore, only a small capital investment needs to be made to start production of the units. Quite to the contrary in the child's carousel art, most such units require plastic injection molds, some of which are extremely large and costly as an initial capital investment.

Returning to FIG. 1, the superstructure 16, in its preferred form for sale to purchasers who are to do the final assembly, comprises one hub 18 and four U-shaped cantilevered arms 20, with the legs of the U being horizontal as finally installed. The hub 18 consists of three parts, a first 5-way fitting 22 at its upper end, a tube 24 extending downwardly therefrom and a second 5-way fitting 26 connected to the bottom of the tube 24. With the exception of the fitting 26, all fittings are used just as purchased. Fitting 26 is modified, however, by cutting out the top portion to enable the tube 24 to pass all the way through to the bottom edge of the fitting 26, as can be seen from the enlargement in FIG. 2. All fittings of this type are internally shouldered to seat the end of the tubing placed into the opening. Therefore, it is necessary, if desired to have the end of tube 24 coincide with the bottom of fitting 26, to also remove the shoulder normally located internally of the downwardly-extending opening in fitting 26. The hub 18 is factory preassembled so that the 5-way fittings 22 and 26 have their openings in their essential vertical alignment in order for the superstructure to go together properly. A misstep by a do-it-yourselfer in attempting to do the hub alignment would make the hub useless.

The U-shaped arms 20, which are shown to be four in number but can be less or more, are also preassembled in the form of my invention that is to be sold in kit form for final assembly by the end purchaser. This is best depicted in FIG. 4, the exploded view. It consists primarily of a tee fitting 28, a straight horizontal tube 30 and a curved upper tube 32. The curve makes the tube 32 into a ninety-degree component. Obviously, instead of a curved, one-piece tube 32, two straight tubes could be joined by an elbow fitting.

For ease of mounting a seat 34 to the outer periphery of the carousel 10 between adjacent arms 20, a short tube 36 extends radially outward from the tee fitting 28, and an end cap 38 is connected to the end of the tube 36. The purpose of the extension provided by the tube 36 and end cap 38 is to enable more firm attachment of the seats 34 to the ends of the arms 20 by means of bolts and metal straps shown generally in FIG. 4 at 40. The seats 34 and their mounting means may be of any construction. In the prototype, the seats 34 were made of wood. Obviously, to further decrease weight of the unit, each seat can be one plastic piece which is blow-molded, vacuum formed or injection molded and either bolted or snapped into place.

Assuming now that the superstructure 16 has all tubes bottomed in the openings into which they are to be received and are cemented in place, let us now see how they are mounted for rotation. A relatively rigid upstanding vertical post 42 is most easily made of three parts, namely, a lower galvanized pipe 44, an upper pipe 46 and a threaded coupling 48 joining threaded ends of the lower and upper pipes. The overall length of the post 42 is from near the bottom of the pipe 14 set into the concrete 12, up through the hub 18 and extending partially into 5-way fitting 22. The external diameter of the pipe 46 and the internal diameter of the tube 24 are sized to give just a small clearance, allowing the tube 24 to rotate freely about the pipe 46.

A spacer tube 50 which is of a length designed to have the seats 34 at a level above the ground an amount which allows a child's feet to touch the ground for propelling the unit is slipped over the pipe 46 before the superstructure 16 is placed in final position. The tube 50 has a half-coupling 52 cemented to each of its ends to provide outwardly opposing shoulders, one for abutting the coupling 48 and the other contacting the underside of a thrust bearing 54. The bearing 54 takes the downward loading from the children and superstructure 16. I have found that excellent coasting capabilities are provided with this design. Without children aboard, the unit can be hand turned and rotate up to thirty to forty revolutions before stopping. This is many times the number of revolutions found in those children's carousels which have come to my attention.

The thrust bearing preferably consists of a needle bearing 56 in its race sandwiched between two washers 58 and 60. Washer 60 rests on a shoulder provide by the tops of spacer tube 50 and the half-coupling 52 at its upper end. The upper surface of washer 58 receives the load from the superstructure 16 in the lower end of 5-way fitting 26 and the bottom end of tube 24.

FIG. 3 is a topside view of a portion of the carousel 10. It shows that notches in each end of each seat 34 surround a portion of the tee fitting 28 but the seats rest on the fittings 28 and end caps 38. An oval area 62 between the inners edges of the seats 34 and the hub is where a child's legs will extend to allow foot contact with the ground beneath. An adult's legs can also fit into area 62 to enable him or her to step thereinto and lift straight upwardly to remove the superstructure 16 either for mowing grass beneath the carousel 10 or for winter indoor storage.

Various changes can be made without departing from the spirit and scope of my invention. While the tubing and fittings are preferably cylindrical and cemented PVC plastic, either the cross-sectional shape or the material can be changed. For example, it is feasible to construct the superstructure of aluminum, although it would be more costly and heavier. Also, provided the joints are made to be tight fitting in order to provide a relatively rigid superstructure, the tubing and fittings can be bolted or riveted.

Having described my invention, I claim:

1. A child's carousel mounted for free rotation about a vertical axis, said carousel comprising 1) a lightweight tubular seat-supporting superstructure surrounding and extending radially outward from said vertical axis to an outer periphery, 2) seating means mounted at said outer periphery at a level above a base surface generally corresponding to the length of a small child's legs between the knees and feet, whereby seated children may propel said carousel by means of their feet against said base surface and 3) a relatively rigid upstanding vertical post adapted to be supported in the base surface and forming said vertical axis about which said carousel is rotatable;

said superstructure comprising an assemblage of elements including:

a) a vertical central hub journaled on said post, said hub including:

i) a first fitting atop said hub, said first fitting having a plurality of upper tube-receiving openings facing radially outward therefrom and spaced angularly equidistantly thereabout, ii) a second fitting mounted below said first fitting and having a like plurality of radially outward-facing lower tube-receiving openings, said openings of said second fitting being vertically aligned with the radial openings of said first fitting, and said second fitting having a vertical opening therethrough receiving said post, and iii) a hollow tube interconnecting said first and second fittings;

b) a plurality of generally U-shaped tubular cantilevered arms extending radially from said hub with inner ends of each arm closely fitting and fixed into a vertically aligned pair of said upper and lower tube-receiving openings of said first and second fittings, and said seating means extending in a horizontal plane between adjacent cantilevered arms and means for fastening said seating means to said superstructure.

2. A child's carousel according to claim 1 wherein said seating means has an inner edge spaced from said hub sufficiently to allow leg room space for a child between said seating means inner edge and said hub and wherein the inner ends of said arms and the openings receiving said inner ends are cylindrical and close-fitting.

3. A child's carousel according to claim 1 wherein said post is provided with a fixed-height upwardly facing shoulder, wherein a freely rotatable thrust bearing is provided and rests on said shoulder, said thrust bearing including an upper washer and a lower washer with a roller bearing and race therefor between said washers, the lower side of said lower washer contacting said shoulder and the upper side of said upper washer contacting the lower end of said hub.

4. A child's carousel according to claim 3 wherein a pipe having an upper open end essentially level with said base surface is vertically anchored in said base surface, and wherein said post has a lower end slidably receivable within said pipe, said superstructure being vertically removable from said post and said post being vertically removable from said pipe whereby the base surface and upper open end of said pipe enables unobstructed use of said base surface whenever said carousel and post are removed.

5. A child's carousel according to claim 4 wherein a collar is affixed to said post, said collar serving to establish the depth of said post in said pipe, and a vertical spacing tube slidably mounted on said post with its lower end engaging said collar, and the upper end of said spacing tube forming the upwardly-facing shoulder on which said thrust bearing rests.

6. A child's carousel according to claim 5 wherein the combined lengths of said collar and said spacing tube generally determine the heights of said seats from said base surface.

7. A child's carousel according to claim 1 wherein said hub and said first and second fittings are initially independent components and are aligned and fixedly cemented into a unitary subassembly structure prior to assembly with said carousel.

8. A child's carousel according to claim 7 wherein each said U-shaped cantilevered arm comprises a first straight tube, a second 90 degree curved tube and a third fitting joining said first and second tubes into its U-shape, said first and second tubes and said third fitting being aligned to present the ends thereof at the proper spacing and alignment with the pair of tube-receiving openings of said hub with which the arm is to be joined.

9. A child's carousel according to claim 8 wherein said first and second tubes and said third fitting are fixedly cemented into a unitary subassembly.

10. A child's carousel according to claim 8 wherein said third fitting is a tee joint, and wherein a short third tube and end cap extend beyond said tee joint in coaxial alignment with and in opposition to said first straight tube, said third tube and end cap comprising an additional seat support and mounting means.

11. A child's carousel mounted for free rotation about a vertical axis, said carousel comprising a lightweight tubular seat-supporting superstructure surrounding and extending radially outward from said vertical axis to an enter periphery and seating means mounted at said outer periphery at a level above a base surface generally corresponding to the length of a small child's legs between the knees and feet, whereby seated children may propel said carousel by means of their feet against said base surface;

a relatively rigid upstanding vertical post adapted to be supported in the base surface and forming said vertical axis about which said carousel is rotatable;

said superstructure comprising an assemblage of elements including:

a) a vertical central hub journaled on said post, said hub including:

i) a first fitting atop said hub, said first fitting having a four cylindrical tube-receiving openings facing radially outward therefrom and spaced ninety degrees apart, ii) a second fitting mounted below said first fitting and having a like number and spacing of radially outward-facing cylindrical tube-receiving openings, said openings of said second fitting being vertically aligned with the radial openings of said first fitting, and said second fitting having a vertical opening therethrough receiving said post, and iii) a hollow tube interconnecting said first and second fittings;

b) four generally U-shaped tubular cantilevered arms extending radially from said hub with the ends of each arm being cylindrical and closely fitting and fixed into a vertically aligned pair of said upper and lower cylindrical tube-receiving openings of said first and second fittings, and said seating means comprising four individual seats extending horizontally between adjacent cantilevered arms, and means for fastening each seat to said superstructure between adjacent cantilevered arms.

12. A child's carousel according to claim 11 wherein a shouldered collar is affixed to said post, and wherein a vertical spacing tube is slidably mounted on said post with the lower end of said spacing tube engaging said collar and the upper end of the spacing tube rotatably supporting said hub.

13. A child's carousel according to claim 11 wherein said hub and said first and second fittings are initially independent components and are aligned and cemented into a unitary subassembly structure prior to assembly with said carousel.

14. A child's carousel according to claim 11 wherein said hub and said first and second fittings are initially independent components and are aligned and fixedly cemented into a unitary subassembly structure prior to assembly with said carousel.

15. A child's carousel according to claim 14 wherein each said U-shaped cantilevered arm comprises a first straight tube, a second 90 degree curved tube and a third fitting joining said first and second tubes into its U-shape, and wherein said first and second tubes and said third fitting are fixedly cemented into a unitary subassembly.

16. A child's carousel according to claim 11 wherein each said seat has an inner edge spaced from said hub sufficiently to allow leg room space for a child between said seat inner edge and said hub.

* * * * *